US005828301A

United States Patent [19]

Sanchez

[11] Patent Number: 5,828,301

[45] Date of Patent: Oct. 27, 1998

[54] ELECTRONICALLY ACTIVATED HOLSTER

[75] Inventor: Luis R. Sanchez, Miami, Fla.

[73] Assignee: Micro Identification, Inc., Miami, Fla.

[21] Appl. No.: 712,008

[22] Filed: Sep. 11, 1996

[51] Int. Cl.[6] ..... G08B 1/08

[52] U.S. Cl. ..... 340/539; 340/568; 340/573; 224/244; 224/245

[58] Field of Search ..... 340/539, 506, 340/511, 568, 571, 572, 573, 665, 668, 825.31, 825.32, 825.34; 70/57.1, 61, 256; 224/244, 245

[56] References Cited

U.S. PATENT DOCUMENTS

| | | | |
|---|---|---|---|
| 3,419,728 | 12/1968 | Wilson | 224/243 |
| 3,530,451 | 9/1970 | Devine | 70/277 |
| 3,939,679 | 2/1976 | Barker et al. | 224/243 |
| 4,354,189 | 10/1982 | Lemelson | 340/825.31 |
| 4,768,021 | 8/1988 | Ferraro | 340/825.31 |
| 5,449,103 | 9/1995 | Tilley | 224/244 |
| 5,479,149 | 12/1995 | Pike | 340/539 |
| 5,508,683 | 4/1996 | Hall | 340/571 |
| 5,525,966 | 6/1996 | Parish | 340/568 |
| 5,598,151 | 1/1997 | Torii | 340/825.32 |

*Primary Examiner*—Jeffery A. Hofsass
*Assistant Examiner*—Daryl C. Pope
*Attorney, Agent, or Firm*—J. Sanchelima

[57] ABSTRACT

An electronically activated holster that releasably secures a weapon to the holster. A locking mechanism releases the weapon upon receiving an electrical signal generated when certain conditions are present. These predetermined conditions are selected by a user and these inputs can be sensed with photosensitive devices attached to the holster that detect bar codes on a user's hand or glove so that a predetermined pattern can be read and conveyed to a control circuit, such as a central processing unit. In turn, the control circuit records the event and causes the locking mechanism to release the weapon if the necessary conditions are present. Alternatively, an ultrasonic transmitter can be worn by a user in a wristband and a cooperative receiver on the holster designed to be activated when a predetermined proximity is achieved. An alarm output is provided to visually or audibly broadcast a violated condition. Optionally, a transmitter is incorporated to the holster to broadcast the condition of the alarm and a remotely placed receiver is used to monitor the broadcast. Another input is supplied by a general positioning system that ascertains the location of the holster at selected times, stores it, and/or broadcasts it. An input/output port permits exchange of data and instructions to and from the control circuit.

19 Claims, 2 Drawing Sheets

ELECTRONICALLY ACTIVATED HOLSTER

II. BACKGROUND OF THE INVENTION

1. Field of the Invention

The present invention relates to weapon holsters, and more particularly, to holsters that include electronic devices that release a lock for the weapon when a predetermined number of conditions are satisfied.

2. Description of the Related Art

It is known that a substantial number of fatalities recorded in the police corps involve the use of the officer's own weapon against him or her. Several designs for holsters already existing provide for mechanisms that lock or secure the weapon. They are typically mechanical devices. The problem with these devices is that if they are effective as a locking mechanism they fail to make the weapon readily available to the user, when required. Also, a wrongdoer may be familiar with the mechanism and release it. With the present invention, an electronic circuit permits a user to withdraw the weapon as the result of meeting a number of conditions intrinsic of the user, or adapted to the user. Additionally, the present invention provides the means to record the dates and times when the weapon was retrieved from and replaced in the holster. This evidential aspect can be useful in court proceedings to establish proper use of the weapon. Many other features differentiate the present invention as claimed from the state of the art.

One of the relevant references known to applicant corresponds to U.S. Pat. No. 4,354,189 issued to Lemelson on Oct. 12, 1982 entitled "Switch and Lock Activating System and Method". This patented device utilizes a ring code with photosensitive or electromagnetic sensors that activate a switch or a door lock. No suggestion is made, however, for using the device for holsters. Nor is there a suggestion of using a force sensor to identify a forceful unauthorized tampering with the device is claimed here. Other features claimed herein are not taught by the reference, as more fully explained below.

Another patent reference of interest is U.S. Pat. No. 3,419,728 issued to Wilson on Dec. 31, 1968 is entitled "Weapon Holster". Basically, this weapon holster uses a push button switch and conditions the release of the weapon to maintain the ignition switch closed. This system can be easily bypassed since. The solenoids act as the locking mechanism, and anyone can push the push button switch and keep the ignition switch running.

U.S. Pat. No. 3,530,4651 issued to Devine on Sep. 22, 1970 entitled "Holster Radio Alarm" discloses an alarm for signaling a remote station. This reference is relevant to show that transmitters have been used in the past with holsters.

U.S. Pat. No. 4,768,021 issued to Ferraro on Aug. 30, 1988 entitled "Safe for Loaded Hand Gun" discloses a device containing a gun with a locking mechanism that is released when a user enters the necessary input through a key pad or a fingerprint identification touch pad. These inputs are not practical for the application sought here, e.g., a walking armed policeman.

Finally, U.S. Pat. No. 3,939,679 issued to Barker et al. on Feb. 29, 1976 entitled "Safety System" discloses a remotely controlled safety system that can be incorporated in a firearm. However, no suggestion of use with a holster, or to record when the fire arm was retrieved from the holster, nor the location of the holster is taught.

III. SUMMARY OF THE INVENTION

It is one of the main objects of the present invention to provide a holster that restricts access to the weapon it houses to unauthorized individuals while providing ready access to those authorized to use it.

It is another object of this invention to provide a holster that prevents the accidental or unauthorized activation of the trigger while the weapon is in the holster.

It is another object of this invention to provide a holster that periodically records the date, time and geographical location of user, including verification of compliance with predetermined parameters.

It is another object of this invention to provide a holster where the time intervals for the periodic recording may be varied.

It is another object of this invention to provide a holster that records the date and time of the withdrawal, replacement or forcible attempt to withdraw the weapon, together with the geographical location of the user at that time.

It is another object of this invention to provide a holster with the appropriate circuitry means to transfer commands and data to and from host computers.

It is another object of this invention to provide a holster with the appropriate circuitry to transmit commands and data to a remote station in real time.

It is another object of the present invention to provide a holster that records the exact times of withdrawal, replacement and forcible attempt(s) to withdraw the weapon from and to the holster, and also detects any forcible attempt to withdraw the weapon, recording it and activating an alarm or other corrective action.

It is still another object of this invention to provide a holster that notifies a remote station of the fact that a weapon has been withdrawn, and if the withdrawal was unauthorized, permitting the remote station to dispatch help or take whatever measures are deemed appropriate under the circumstances.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. BRIEF DESCRIPTION OF THE PREFERRED EMBODIMENT

Figure 1:
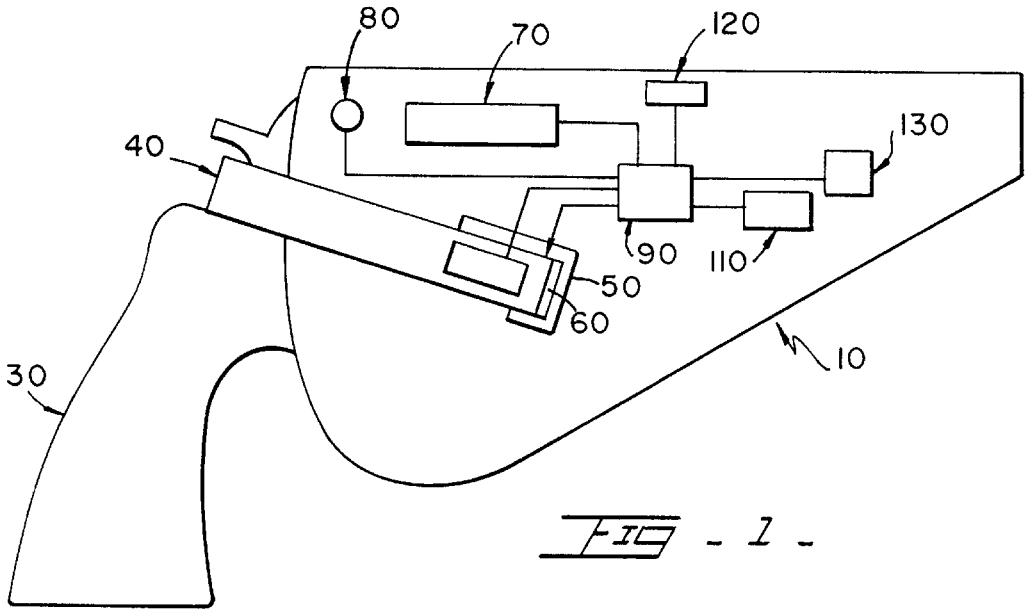
FIG. 1 illustrates a holster showing the location of the main components used in the preferred embodiment of this invention.
Figure 2:
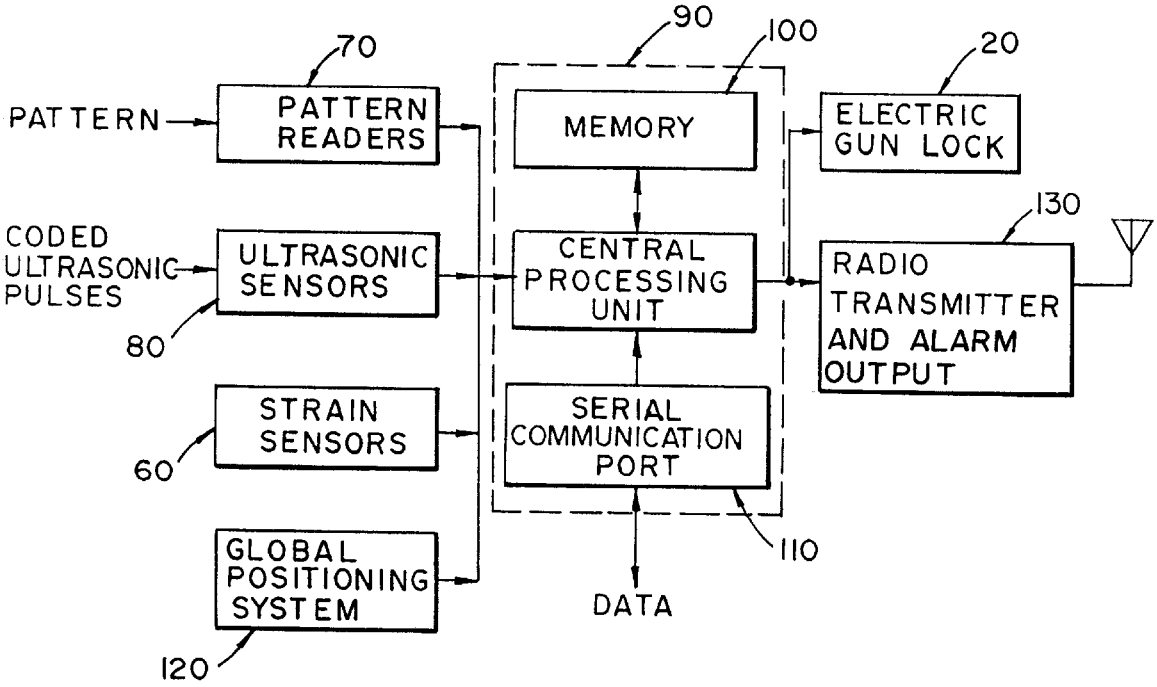
FIG. 2 represents a block schematic of the circuit to be used to implement the present invention.
Figure 3:
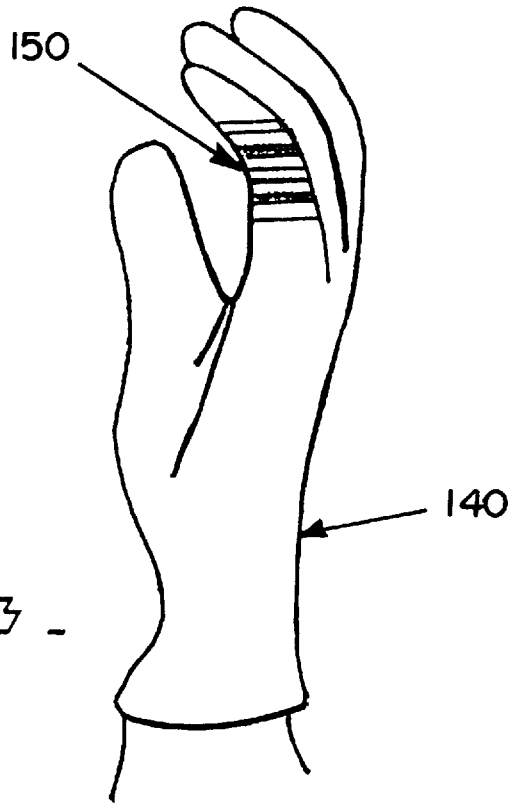
FIG. 3 shows a glove incorporating a coded pattern designed to be detected by a pattern reader in the holster.
Figure 4:
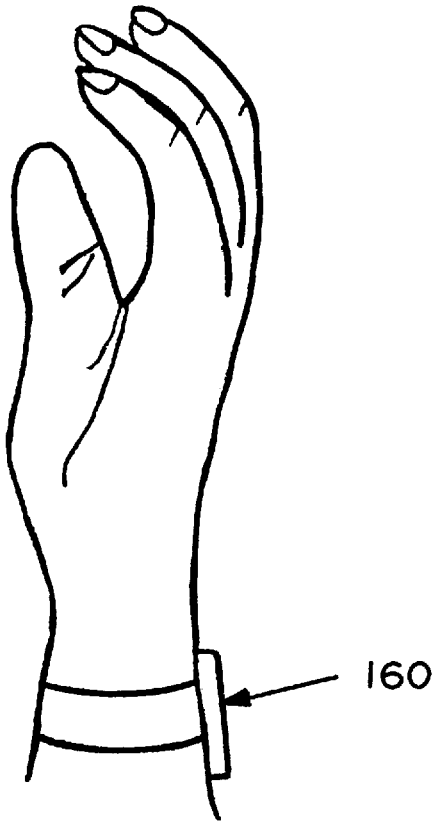
FIG. 4 shows an alternative approach utilizing an ultrasonic transmitter worn by a user on his or her wrist.

The present invention includes weapon holster 10 that in many respects has the characteristic of a conventional holster. However, it also includes locking mechanism 20 that is releasable when a predetermined electrical signal is received from a control circuit 90. This control circuit in turn is responsive to a number of predetermined inputs and when the conditions of these inputs are such that certain criterion is satisfied, the releasing electrical signal is emitted thereby releasing weapon 30.

Locking mechanism 20 includes strap member 40 that is permanently mounted to holster 30 at one end (not shown) and the other end is releasably mounted through latching assembly 50 to holster 30. Strain sensor 60 is mounted to the releasable end of strap member 40 in order to sense any distension force exerted on strap member 40, such as a forceful attempt by others to retrieve weapon 30. If sensor 60 detects a force that exceeds a given limit, a suitable signal appears on the output of sensor 60 which is connected to control circuit 90.

Control circuit 90 is connected to one or more pattern readers 70 (optical, infrared, magnetic, magnetic or otherwise) appropriately located on holsters 10. It is only when the user's hand, wearing glove 140 with the appropriate pattern or patterns 150, is in the proper position with respect to holster 10, that control circuit 90 emits an electrical signal thereby releasing weapon 30. Control circuit 90 can also store in memory 100 the distinctive reference pattern or patterns 150 of one or more gloves 140, thereby allowing for one or more authorized users to be validated.

The input conditions required to release locking mechanism 20 vary from user to user but, in one of the applications, it is possible that if sensor 60 emits an output, control circuit 90 disables any other inputs temporarily or permanently. If temporarily, the user will know that he or she will not be able to withdraw the weapon for a predetermined time period. If permanently, control circuit 90 would have to be reset. Resetting is achieved through serial port 110.

Alternatively, holster 10 may also include one or more ultrasonic receivers 80 appropriately located on holster 10 to receive coded signals emitted by ultrasonic transmitter 160 worn by the user on any appropriate location such as his or her wrist. It is only when the user's hand is in the proper position in respect to holster 10, that control circuit 90 emits an electrical signal thereby releasing weapon 30. Control circuit 90 can store in memory 100 the distinctive codes of one or more ultrasonic transmitters 160, thereby allowing for one or more than one authorized user to be validated.

Control circuit 90 includes non-volatile or battery powered memory 100 where all holster 10 related activities such as weapon 30 withdrawal, replacement or forcible withdrawal attempts are recorded with the date, time and geographical location of the user. Control circuit 90 further includes serial port 110 that serves to transfer commands and data to and from other compatible circuits, such as host computers. Control circuit 90 also includes any suitable geographical position reporting system such as a Global Positioning System (GPS) receiver 120, or alternatively, the geographical location of the user can be periodically established by any suitable permanently mounted host computer that confirms the physical presence of the user by sending location information to holster 10 by means of serial port 110.

Another embodiment for the present invention includes transceiver 130 for sending and receiving information through port 110. Or, for instance, in more restricted use, a signal protocol is sent requesting permission for the withdrawal of the weapon. This of course, will be determined by the particular circumstances of the case.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A holster for releasably holding a weapon upon the occurrence of one or more predetermined conditions, comprising:

a) control circuit means including memory means for storing instructions and data;

b) at least one input sensor means having an output connected to said control circuit means and said input means sensing a plurality of conditions including said predetermined conditions that releases said weapon; and c) locking means for securing said weapon to said holster and having an input connected to said control circuit means so that said locking means is released upon the occurrence of said predetermined conditions.

2. The holster set forth in claim 1, further including:

d) strain sensor means for detecting a force beyond a predetermined magnitude that is applied to said locking means, and said strain sensor means including an output that is connected to said control circuit means.

3. The holster set forth in claim 2, wherein said input means includes photosensitive means mounted on said holster and designed to recognize a predetermined pattern within the control of a user.

4. The holster set forth in claim 3, wherein said photosensitive means includes at least one photo transistor array.

5. The holster set forth in claim 4, further including:

e) alarm means activated by said control circuit means when said predetermined conditions are present.

6. The holster set forth in claim 5, wherein said alarm means includes transmitter means for broadcasting the activation of said alarm means and cooperative receiver means for remotely monitoring said broadcast.

7. The holster set forth in claim 6, wherein said control circuit means stores the date and time when said predetermined conditions are present.

8. The holster set forth in claim 7, wherein said control circuit means includes a central processing unit.

9. The holster set forth in claim 1, wherein said input means includes ultrasonic sensor means mounted to said holster and ultrasonic transmitter means designed to be detected by said ultrasonic sensor means when brought by a user within a predetermined distance of the latter thereby causing said locking means to release said weapon.

10. The holster set forth in claim 9, further including:

d) strain sensor means for detecting a force beyond a predetermined magnitude that is applied to said locking means, and said strain sensor means include an output that is connected to said control circuit means.

11. The holster set forth in claim 10, further including:

e) alarm means activated by said control circuit means when said predetermined conditions are present.

12. The holster set forth in claim 11, wherein said alarm means includes transmitter means for broadcasting the activation of said alarm means and cooperative receiver means for remotely monitoring said broadcast.

13. The holster set forth in claim 12, wherein said control circuit means stores the data and time when said predetermined conditions are present.

14. The holster set forth in claim 13, wherein said control circuit means includes a central processing unit.

15. The holster set forth in claim 1, wherein said input means includes a global positioning system to ascertain the location of said holster and said location being selectively and periodically stored by said control circuit means.

16. The holster set forth in claim 15, further including: d) strain sensor means for detecting a force beyond a predetermined magnitude that is applied to said locking means, and said strain sensor means include an output that is connected to said control circuit means.

17. The holster set forth in claim 16, further including:

i) alarm means activated by said control circuit means when said predetermined conditions are met.

18. The holster set forth in claim 17, further including:

j) transmitter means for broadcasting the activation of said alarm means and the location ascertained by said global positioning system.

19. The holster set forth in claim 18, wherein said control circuit means includes a central processing unit.

* * * * *